US006086405A

United States Patent [19]

Liebich

[11] Patent Number: 6,086,405

[45] Date of Patent: Jul. 11, 2000

[54] CONTACT MEMBER WITH DOUBLE INSULATION DISPLACEMENT TERMINAL

[75] Inventor: Ernst Liebich, Geltendorf, Germany

[73] Assignee: TYCO Electronics Logistics AG, Steinach/SG, Switzerland

[21] Appl. No.: 09/281,102

[22] Filed: Mar. 29, 1999

Related U.S. Application Data

[63] Continuation of application No. PCT/DE97/01537, Jul. 18, 1997.

[30] Foreign Application Priority Data

Sep. 27, 1996 [DE] Germany ..... 196 39 911

[51] Int. Cl.[7] ..... H01R 4/24

[52] U.S. Cl. ..... 439/397

[58] Field of Search ..... 439/397, 398, 439/404

[56] References Cited

U.S. PATENT DOCUMENTS

| | | | |
|---|---|---|---|
| 3,227,991 | 1/1966 | Zdanis | 439/397 |
| 4,118,103 | 10/1978 | Leidy et al. | 439/398 |
| 4,548,676 | 10/1985 | Carrell | 439/404 |
| 5,399,098 | 3/1995 | Marshall et al. | 439/398 |

FOREIGN PATENT DOCUMENTS

| | | | |
|---|---|---|---|
| 0101290 | 2/1984 | European Pat. Off. | 439/398 |
| 0101290A2 | 2/1984 | European Pat. Off. . | |

*Primary Examiner*—Paula Bradley
*Assistant Examiner*—Briggitte R. Hammond
*Attorney, Agent, or Firm*—Herbert L. Lerner; Laurence A. Greenberg; Werner H. Stemer

[57] ABSTRACT

A contact member includes a double insulation displacement terminal with two parallel insulation displacement terminal contact limbs which are connected to one another through a central part. The central part is provided with apertures and cutouts which are matched to the geometry of plug-in blade contacts.

5 Claims, 2 Drawing Sheets

CONTACT MEMBER WITH DOUBLE INSULATION DISPLACEMENT TERMINAL

CROSS-REFERENCE TO RELATED APPLICATION

This application is a continuation of copending International Application No. PCT/DE97/01537, filed Jul. 18, 1997, which designated the United States.

BACKGROUND OF THE INVENTION

Field of the Invention

The invention relates to a contact member including a double insulation displacement or piercing terminal having two contact limbs which are parallel to one another and are each provided with an insulation displacement terminal contact slot, and a central part which connects the two contact limbs to one another.

In order to provide an electrical connection between insulated electrical conductors without stripping the insulation, contact members are often provided with insulation displacement terminals which include two contact limbs that are parallel to one another and are each provided with an insulation displacement terminal contact slot, and a central part which connects the contact limbs to one another. The insulation displacement terminal generally forms an area which is U-shaped in cross section and is attached to a contact area of the contact member, for example to a contact spring for contacting a plug contact, or is formed integrally with that contact area. A contact member of that nature is known, for example, from German Utility Model DE-U 89 09 562.

SUMMARY OF THE INVENTION

It is accordingly an object of the invention to provide a contact member with a double insulation displacement terminal, which overcomes the hereinafore-mentioned disadvantages of the heretofore-known devices of this general type and which provides a contact member having a compact structure suitable for contacting blade contacts.

With the foregoing and other objects in view there is provided, in accordance with the invention, a contact member, comprising a double insulation displacement terminal having two mutually parallel contact limbs and a central part connecting the two contact limbs to one another; the contact limbs each having an insulation displacement terminal contact slot formed therein; the central part having free longitudinal sides and at least one slot-like cutout extended approximately parallel to the free longitudinal sides; and the at least one slot-like cutout having a round or rectangular aperture matched to a geometry of a contact pin passing through the at least one slot-like cutout as a contact area for the contact pin.

In a contact member of this nature, the central part, which connects the contact limbs to one another, is constructed with at least one cutout for plugging in a blade contact so that, in addition to its function as a connecting component for the contact limbs, the central part simultaneously also serves as a plug contact area for a plug-in blade contact. In this way, it is possible to construct a contact member with an extremely compact structure combining a double insulation displacement terminal and a plug contact area. The contact member according to the invention can therefore be produced with very small dimensions in terms of structural height and structural length and is particularly advantageously suited to contacting blade contacts which are perpendicular to the insulation displacement terminal, i.e. blade contacts which can be plugged in perpendicular to the plane of the central part. When blade contacts are plugged into cutouts in the central part, the width of those cutouts increases in the transverse direction, i.e. transversely with respect to the free longitudinal sides of the central part, thus producing the contact force. The opening width and the length of the cutouts in the central part are expediently constructed and matched to the geometry of blade contacts in such a manner that the contact force required is available.

Advantageously, in a contact member according to the invention, the cutout is constructed in the form of a slot, in which case it runs approximately parallel to the free longitudinal sides of the central part, i.e. transversely with respect to the contact limbs. A cutout of this nature can then directly form the contact area for a flat blade contact.

However, if the central part in a contact member according to the invention serves as the plug contact area for round or rectangular contact pins, it is expedient if the slot-like cutout has a round or rectangular aperture, which is matched to the geometry of a contact pin passing through it as the contact area for the contact pin.

In accordance with another feature of the invention, the at least one cutout and/or the aperture have lead-ins on a plug-in side.

In accordance with a further feature of the invention, the central part has a given total length, and the at least one cutout extends beyond the given total length into the contact limbs.

In accordance with an added feature of the invention, the insulation displacement terminal contact slots have an open insertion side and a side opposite the open insertion side, and the central part connects the contact limbs to one another at the opposite sides.

In accordance with an additional feature of the invention, the central part has a length with a center, and the at least one cutout in the central part is two mutually parallel slot-like cutouts each having an aperture for a blade contact approximately in the center.

In accordance with yet another feature of the invention, the contact limbs have two side edges facing away from one another with projections for fixing the contact member in a housing.

In accordance with yet a further feature of the invention, the projections have a pine-tree-like geometry.

In accordance with a concomitant feature of the invention, the projections are disposed in a region outside the insulation displacement terminal contact slots of the contact limbs and the apertures.

Other features which are considered as characteristic for the invention are set forth in the appended claims.

Although the invention is illustrated and described herein as embodied in a contact member with a double insulation displacement terminal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
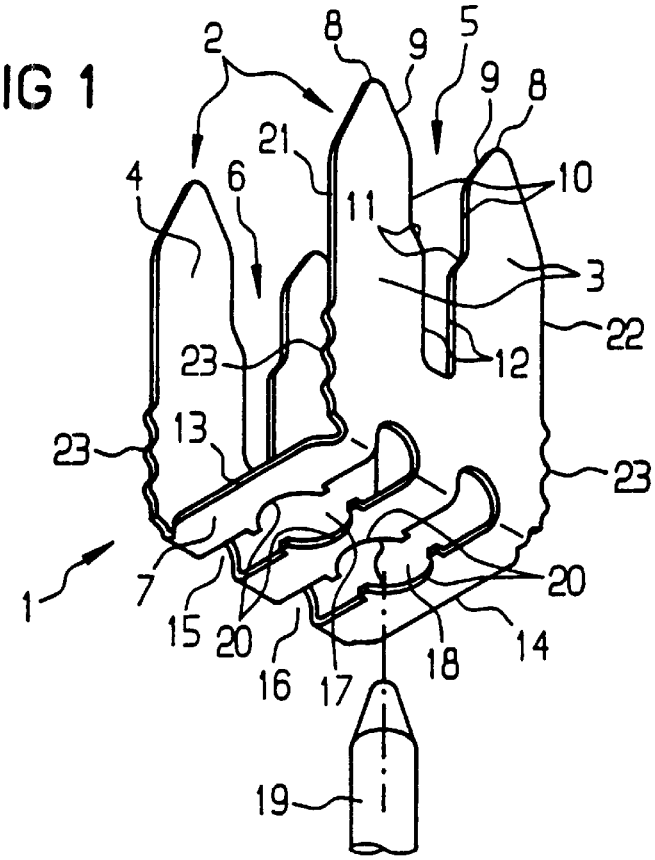
FIG. 1 is a diagrammatic, perspective view, from below, of a contact member with a double insulation displacement terminal.

Referring now to the figures of the drawings in detail, there are seen contact members 1, 1*a* and 1*b* each of which is formed by a component that is U-shaped in cross section, is produced from a sheet metal part using a punching and bending process and has a double insulation displacement or piercing terminal 2 for electrical connection of an insulated electrical conductor 28 without stripping insulation. The double insulation displacement terminal 2 includes two contact limbs 3, 4 which are parallel to one another and are each provided with an insulation displacement terminal contact slot 5, 6.

Figure 2:
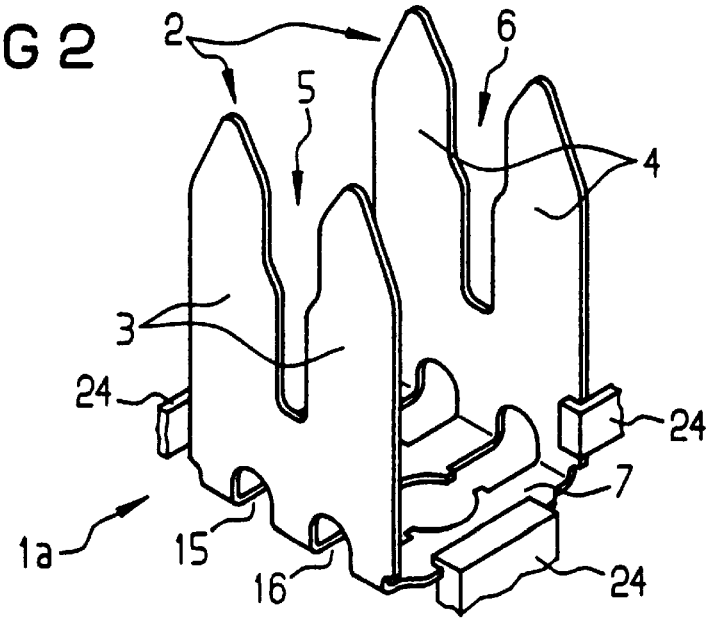
FIG. 2 is a perspective view, from one side, of the double insulation displacement terminal of another contact member.

In the case of the embodiments of FIGS. 1 and 2, the contact limbs 3, 4 are connected to one another through a central part 7 which forms a base of the contact member. The contact limbs 3, 4 are connected at sides thereof which lie opposite open insertion sides of the insulation displacement terminal contact slots. In these embodiments, the insulation displacement terminal contact slots 5, 6 are constructed in a particular way which is known from German Published, Non-prosecuted Patent Application DE 41 08 133. The insulation displacement terminal contact slots 5, 6 have cutting points 8, cutting edges 9, orientation edges 10, deformation edges 11 in the insertion area and clamping edges 12 in the clamping area of the contact slot. In the case of the contact member 1 shown in FIG. 1, the insulation displacement terminal contact slots 5, 6 extend, for example, over approximately two thirds of the height of the contact limbs 3, 4.

The central part 7 of the contact member 1 in this case is constructed with two slot-like cutouts 15, 16 which are parallel to one another and to free longitudinal sides 13, 14. In the longitudinal direction of the central part 7, i.e. transversely with respect to the contact limbs 3, 4, the slot-like cutouts 15, 16 extend beyond the entire length of the central part, through bends of the contact limbs 3, 4 and as far as into these contact limbs. The slot-like cutouts 15, 16 are each provided with a round aperture 17, 18, approximately in the center of the length of the central part 7. The cutouts pass through the diameter of the apertures 17, 18, as a contact area for blade contacts 19, which in this case are constructed as round contact pins. These apertures 17, 18 in this case are matched to the geometry of the blade contacts which can be plugged into the central part. The apertures 17, 18 are constructed with lead-ins 20, in the form of run-in radii or run-in slopes on the plug-in side, i.e. on the underside of the central part 7, in order to make it easier to insert the blade contacts. When the blade contacts 19 are plugged into the apertures 17, 18, these apertures and the cutouts 15, 16 widen elastically in the transverse direction and, as a result, produce a contact force. In order for a sufficient level of this force to be available, the opening width of the apertures 17, 18 and the length of the slot-like cutouts 15, 16 is appropriately adapted to the thickness of the blade contacts.

If the contact member 1 is to be fixed securely in a housing, it is expedient for the contact limbs 3, 4 to have projections 23 on two side edges 21, 22 thereof which face away from one another. The projections advantageously have a pine-tree-like geometry which is inverted in the illustrated exemplary embodiment, in order to absorb plug-in forces that act on the central part 7 from below in FIG. 1. The projections 23 are provided in a stable area of the contact limbs 3, 4 outside the insulation displacement terminal contact slots 5, 6 and the apertures 17, 18, in order not to impede the widening of the insulation displacement terminal contact slots 5, 6 or the apertures 17, 18 forming contact openings.

If the contact member 1*a* of FIG. 2 is mounted in a floating manner in a housing, it is possible to achieve this through the use of resilient snap-action hooks 24 of the housing. The hooks engage around and secure either the central part 7, which forms the base, or the two contact limbs 3, 4 of the contact member 1*a*.

Figure 3:
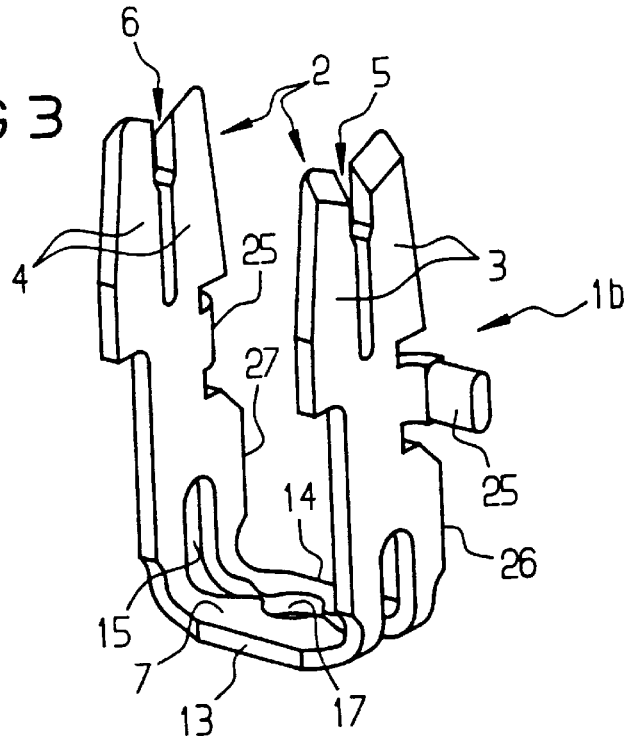
FIG. 3 is a perspective view of a further embodiment of a contact member.
Figure 4:
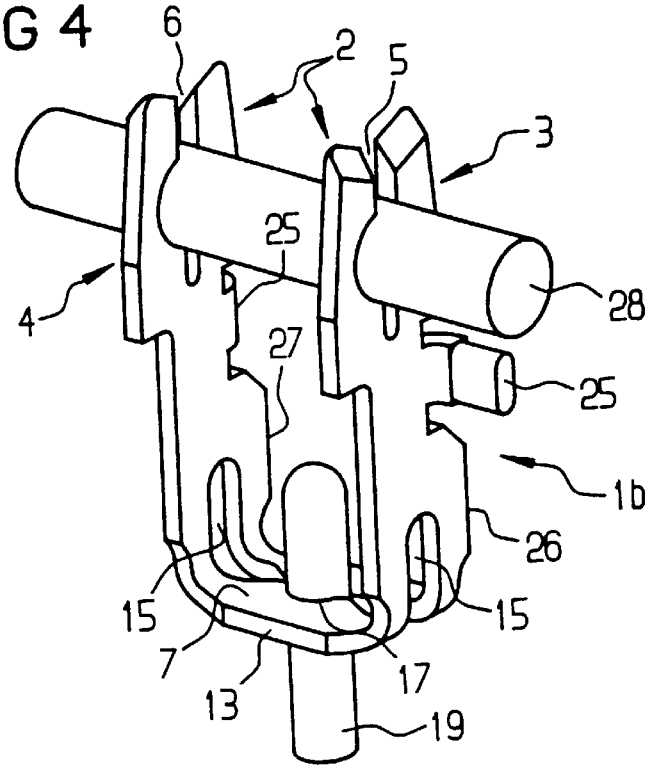
FIG. 4 is a perspective view of the contact member according to FIG. 3 with a cable and blade contact terminal.

Furthermore, in order to fix a contact member in a housing, it is possible, as in the case of the contact member 1*b* shown in FIGS. 3 and 4, to provide attachment lugs 25, for example on rear side edges 26, 27 of the contact limbs 3, 4. The attachment lugs 25 are bent sideways and snap into resilient latching elements, for example, inside the housing. In the case of the contact member 1*b*, these attachment lugs are disposed immediately below the insulation displacement terminal area of the contact limbs 3, 4. In addition, the basic structure of the contact member 1*b* in accordance with FIGS. 3 and 4, as well as the functioning and construction of the central part 7, correspond to the contact member 1 shown in FIG. 1. The contact member 1*b* differs from the contact member 1 only in that unlike the latter it has only one cutout 15 for a blade contact which is constructed as a round contact pin.

In the illustrated exemplary embodiments, the contact member is constructed with apertures for pin-like blade contacts in its central part 7. However, it is also possible for flat blade contacts to be plugged into the central part if the geometry of the apertures or of the slot-like cutouts themselves is adapted appropriately.

Furthermore, as a modification to the illustrated exemplary embodiments, it is also possible for the contact limbs 3, 4 to be connected through the central part 7 at the sides, i.e. for example at the side edges 21 or 22 of the contact limbs 3, 4.

What is claimed is:

1. A contact member, comprising:

a double insulation displacement terminal having two mutually parallel contact limbs and a central part connecting said two contact limbs to one another;

said contact limbs each having an insulation displacement terminal contact slot formed therein;

said central part having a length with a center;

said central part having free longitudinal sides and two mutually parallel slot-like cutouts extending approximately parallel to said free longitudinal sides; and said slot-like cutouts each having a round or rectangular aperture serving as a contact area for receiving a contact pin, each said aperture matched to a geometry of the respective contact pin.

2. The contact member according to claim 1, wherein said slot-like cutouts extend beyond said length of said central part into said contact limbs.

3. The contact member according to claim 1, wherein said insulation displacement terminal contact slots have an open insertion side and a side opposite said open insertion side.

4. The contact member according to claim 1, wherein said contact limbs have two side edges facing away from one another with projections for fixing said contact member in a housing.

5. The contact member according to claim 4, wherein said projections are disposed in a region outside said insulation displacement terminal contact slots of said contact limbs and said apertures.

* * * * *